US005778147A

United States Patent [19]

Kim

[11] Patent Number: 5,778,147

[45] Date of Patent: Jul. 7, 1998

[54] DEW PREVENTING DEVICE FOR AIR CONDITIONERS

[75] Inventor: Yong-Gu Kim, Suwon, Rep. of Korea

[73] Assignee: Samsung Electronics Co., Ltd., Suwon, Rep. of Korea

[21] Appl. No.: 509,575

[22] Filed: Jul. 31, 1995

[30] Foreign Application Priority Data

Jul. 29, 1994 [KR] Rep. of Korea ..... 94-19274

[51] Int. Cl.[6] ..... F24F 13/06; F24F 11/02

[52] U.S. Cl. ..... 392/473; 62/80; 62/176.6; 62/176.2

[58] Field of Search ..... 392/473; 219/201, 219/203; 62/150, 176.1, 176.5, 176.6, 209, 80, 176.2, 275; 236/44 R, 44 B, 44 C; 137/341

[56] References Cited

U.S. PATENT DOCUMENTS

| | | | |
|---|---|---|---|
| 4,482,007 | 11/1984 | Yoshimi et al. | 62/209 |
| 4,862,701 | 9/1989 | Small et al. | 62/150 |
| 4,903,501 | 2/1990 | Harl | 137/341 |
| 5,163,503 | 11/1992 | Inoue | 62/150 |
| 5,657,636 | 8/1997 | Suggs | 62/80 |

FOREIGN PATENT DOCUMENTS

| | | |
|---|---|---|
| 53-146351 | 12/1978 | Japan . |
| 61-184350 | 8/1986 | Japan . |
| 61-250438 | 11/1986 | Japan . |
| 63-19778 | 4/1988 | Japan . |
| 1-33457 | 2/1989 | Japan . |
| 2-37245 | 2/1990 | Japan . |
| 3-274346 | 12/1991 | Japan . |

*Primary Examiner*—John A. Jeffery
*Attorney, Agent, or Firm*—Burns, Doane, Swecker & Mathis, L.L.P.

[57] ABSTRACT

A dew preventing mechanism prevents the formation of dew on the grilles of an air discharge port of a room air conditioner by activating a heater which heats the grilles in response to the sensing of certain dew-forming conditions. The air conditioner includes thermistors for sensing the temperatures of incoming room air and outgoing cooled air, respectively, and a hygrometer for sensing the humidity of incoming room air. Signals proportional to those temperatures and humidity are sent to a control device which calculates the dew point of the incoming room air and compares the humidity of the incoming air with a reference humidity. When the outgoing air temperature is less than the dew point, and/or the incoming air humidity exceeds the reference humidity, the heater is actuated.

11 Claims, 6 Drawing Sheets

DEW PREVENTING DEVICE FOR AIR CONDITIONERS

BACKGROUND OF THE INVENTION

1. Field of the Invention

The present invention relates in general to a dew preventing device for air conditioners and, more particularly, to a device for preventing dew-forming at the air discharge grille of an air conditioner.

2. Description of the Prior Art

FIG. 4 shows a typical air conditioner disclosed in Japanese Patent Publication No. Sho. 63-19778.

As shown in the drawing, the above Japanese air conditioner includes a grilled air suction port 133 for sucking the room air into the air conditioner housing 131. The air suction port 133 is provided in the lower portion of the housing's front wall. In the air conditioner housing 131, the room air circulates about a heat exchanger (not shown). Room air can either be cooled or warmed with refrigerant flowing in the heat exchanger. In order to discharge the room air, which has been cooled or heated by the heat exchanger, a grilled air discharge port 132 is provided in the upper portion of the housing's front wall. In FIG. 1, the reference numeral 137 denotes a control knob for controlling an air filtering damper (not shown) installed in the housing (131).

In the operation of the above air conditioner, the room air is sucked into the housing 131 through the grilled air suction port 133. In the housing 131, for example, the heat exchanger cools the room air with refrigerant. The cooled air in turn is discharged back into the room through the grilled air discharge port 132 thereby cooling the room.

However, when the above air conditioner performs the cooling operation, the cooled air discharged from the air conditioner into the room meets with the hot room air at the grilled air discharge port 132, thereby forming dew on the grille of that port 132. The dew flows down on the front wall of the housing 131 and moistens a control panel 180 of the front wall, thereby causing the air conditioner to short circuit. The dew formed on the grilled port 132 thus makes the housing 131 dirty and may cause the air conditioner to malfunction or start a fire. Therefore, the dew may cause financial loss and bring the owner trouble.

SUMMARY OF THE INVENTION

It is, therefore, an object of the present invention to provide a dew preventing device for air conditioners in which the above problems can be overcome and which prevents dew-forming on the grilles of an air discharge port of an air conditioner, thereby preventing financial loss, keeping the air conditioner clean and being convenient to users.

In order to accomplish the above object, a dew preventing device for air conditioners in accordance with a preferred embodiment of the invention comprises: control means for controlling the dew preventing device; a first temperature sensor for detecting room air temperature and applying a room air temperature signal to the control means; a humidity sensor for detecting room air humidity and applying a humidity signal to the control means; a second temperature sensor for detecting the temperature of a grilled air discharge port and applying a port temperature signal to the control means; and a heater for generating heat in response to a drive signal outputted from the control means in accordance with the room air temperature signal of the first temperature sensor, the humidity signal of the humidity sensor and the port temperature signal of the second temperature sensor, thereby heating the grilled air discharge port and preventing dew-forming on grilles of that port.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENT

Figure 1A:
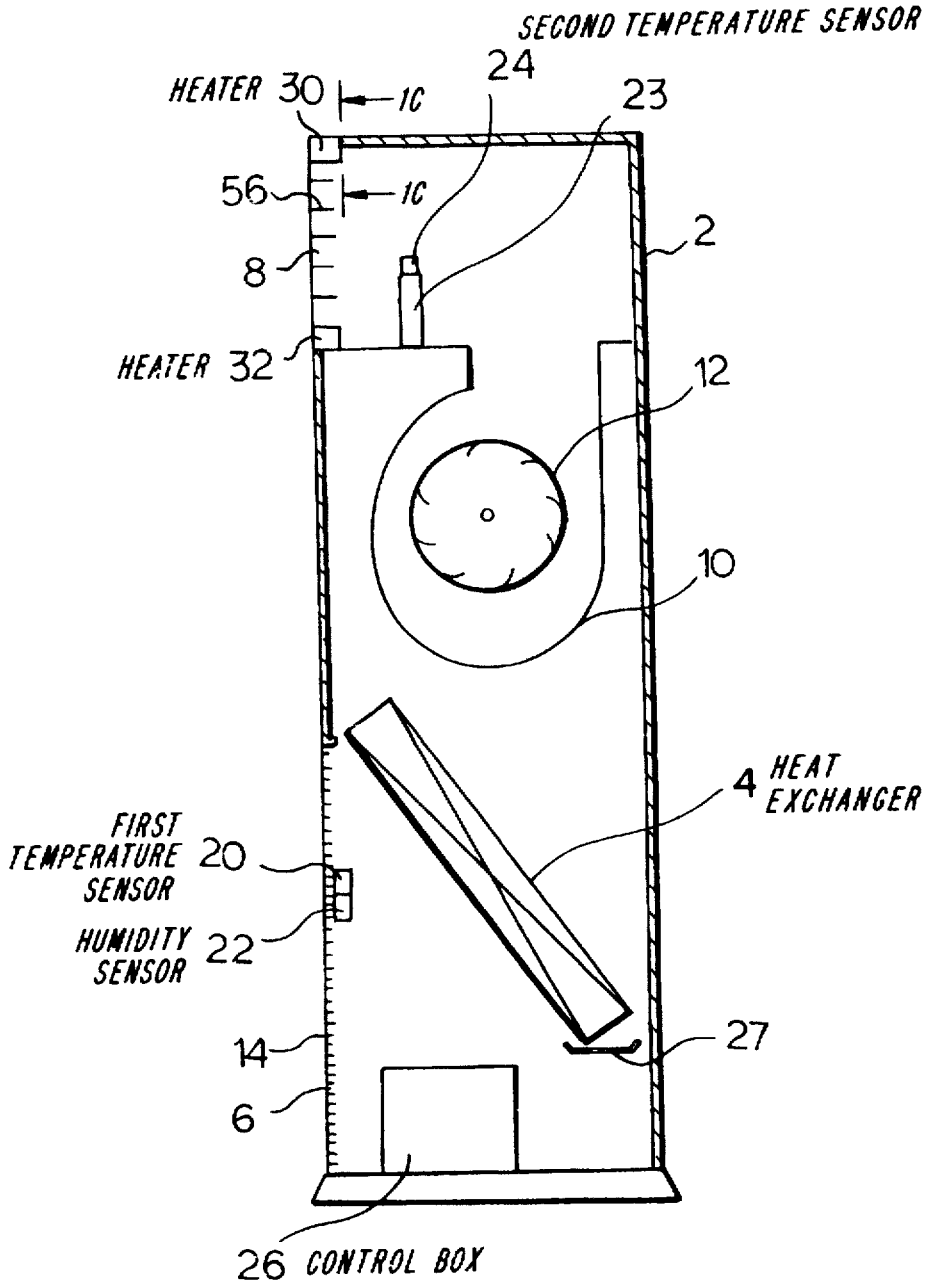
FIG. 1A is a sectional view of an air conditioner having a dew preventing device in accordance with a preferred embodiment of the invention; and taken along the line 1A—1A in FIG. 1B
Figure 1B:
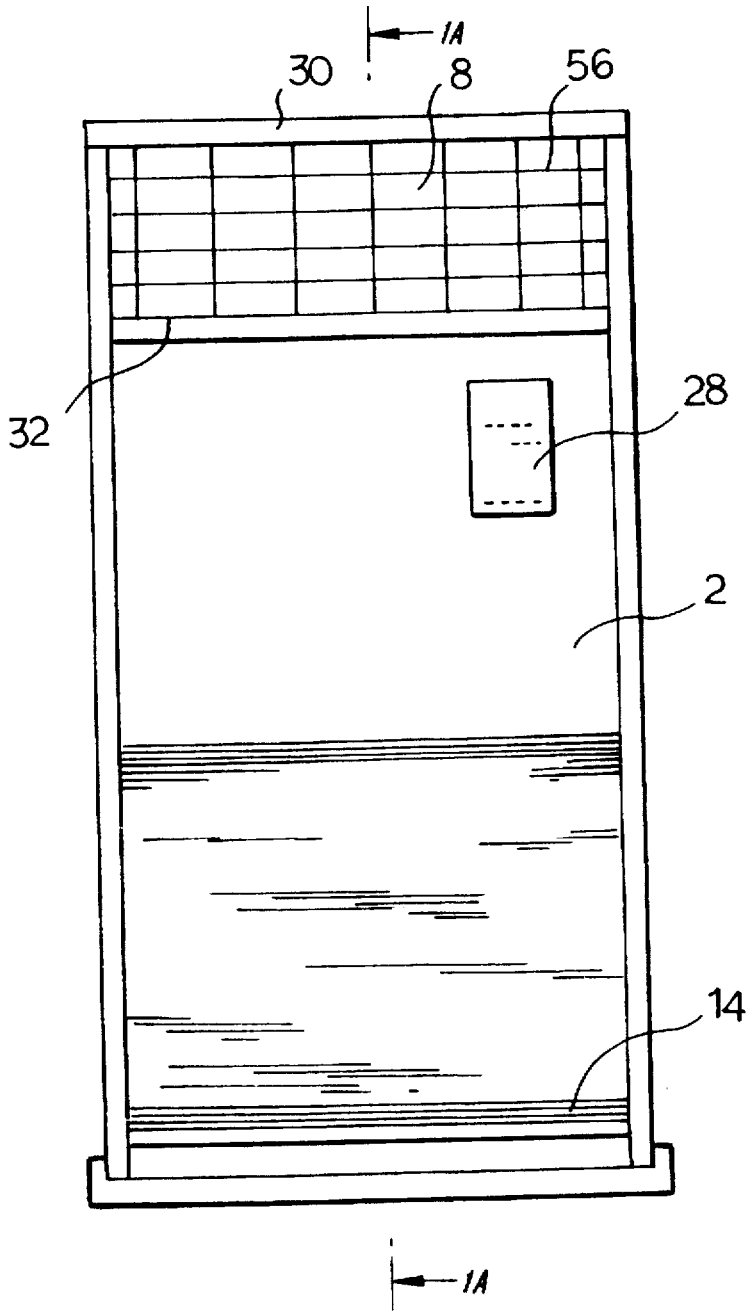
FIG. 1B is a front view of the air conditioner of FIG. 1.
Figure 1C:
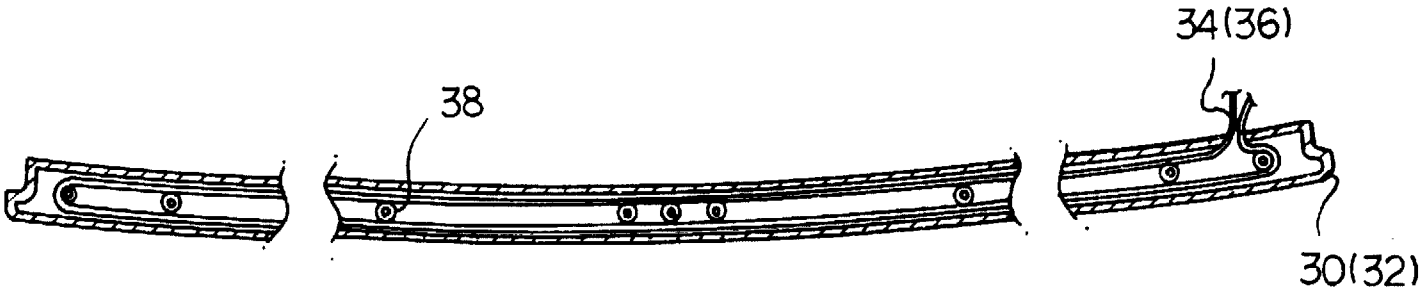
FIG. 1C is a sectional view of a holder provided in the air conditioner of FIGS. 1A and 1B; and taken along line 1C—1C in FIG. 1A

FIG. 1A is a sectional view of an air conditioner having a dew preventing device in accordance with a preferred embodiment of the invention, FIG. 1B is a front view of the air conditioner of this invention, and FIG. 1C is a sectional view of a holder provided in the grilled air discharge port of the above air conditioner.

As shown in the drawings, the air conditioner of this invention has a heat exchanger 4 provided at the center of the interior of the housing 2 as shown in FIG. 1A. The air conditioner also includes a grilled air suction port 6 for sucking the room air into the air conditioner housing 2 as shown in FIG. 1B. The air suction port 6 is provided in the lower portion of the housing's front wall. In order to discharge the room air, which has been cooled or heated by the heat exchanger 4, into the room, the grilled air discharge port 8 is provided in the upper portion of the housing's front wall. A blower fan 12 is provided above the heat exchanger 4 in the housing 2 to propel the air, which has been cooled or heated by the heat exchanger 4, to the grilled air discharge port 8 by way of a duct 10.

A first temperature sensor 20, which detects room air temperature, is mounted to the grille 14 of the air suction port 6. In the same manner, a humidity sensor 22 for detecting room air humidity is mounted to the grille 14 of the air suction port 6. A second temperature sensor 24, which detects the temperature of the cooled air discharged from the housing 2 through the grilled air discharge port 8, is mounted to the housing 2 inside that port 8 by a support 13. Mounted on the floor of the housing 2 is a control box 26 having a control circuit including control means which will be described later herein. A tray 27 for collecting the water condensed on the heat exchanger 4 is provided under the heat exchanger 4 in the housing 2.

As shown in FIG. 1B, a control panel 28 not only for inputting the user's operating selections but also for displaying a operating state of the air conditioner is mounted to the center of the housing's front wall.

A pair of holders 30 and 32 are provided at the top and bottom of the air discharge port 8 respectively as shown in FIG. 1B. The holders 30 and 32 hold respective heaters 34 and 36. The heaters 34 and 36 heat their associated holders 30 which 32 and in turn heat the grilled air discharge port 8. As shown in FIG. 1C, each holder 30, 32 is provided with a plurality of projections 38. The projections 38 are not only for preventing contact between the heating wires of each heater 34, 36 but also for fixing each holder 30, 32 to the housing 2. The projections 38 are constructed of an insulating plastic resin, while the holders 30 and 32 are constructed of metal panels suitable for easily transmitting the heat of the heaters 34 and 36 to the air discharge port 8.

Figure 2:
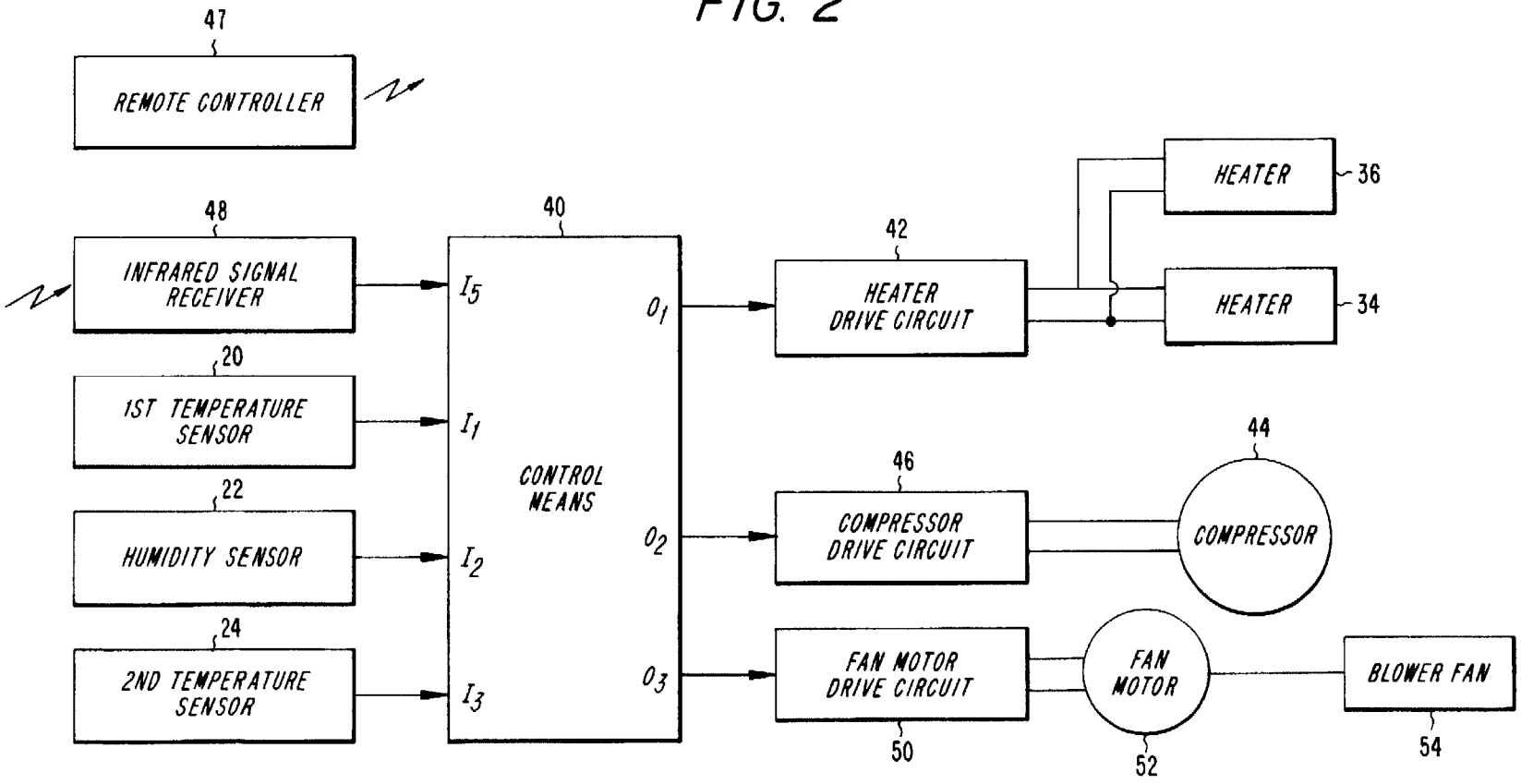
FIG. 2 is a block diagram showing the construction of the dew preventing device of the invention.

Turning to FIG. 2, there is shown in a block diagram the construction of the dew preventing device of the invention. As shown in this drawing, the dew preventing device of this invention also includes the control means 40. The means 40 is a microcomputer which controls the operation of the air conditioner.

The first temperature sensor 22 for detecting the room air temperature and outputting a room air temperature signal to the control means 40 is a thermistor.

The humidity sensor 22 for detecting the room air humidity and outputting a room air humidity signal to the control means 40 is an electric resistance hygrometer.

The second temperature sensor 24 for detecting the temperature of the grilled air discharge port 8 and outputting a port temperature signal to the control means 40 is a thermistor.

The heaters 34 and 36 for heating the air discharge port 8 and raising the dew point of the port 8 to prevent dew-forming at the grille of that port 8 are coupled to a heater drive circuit 42. This heater drive circuit 42 applies a voltage to the heaters 34 and 36 in response to a heater drive signal outputted from the control means 40.

The air conditioner also includes a compressor 44 which compresses the refrigerant to be used for cooling or heating the room air. The compressor 44 is coupled to a compressor drive circuit 46 which applies a voltage to the compressor 44 in response to a compressor drive signal outputted from the control means 40.

Figure 3:
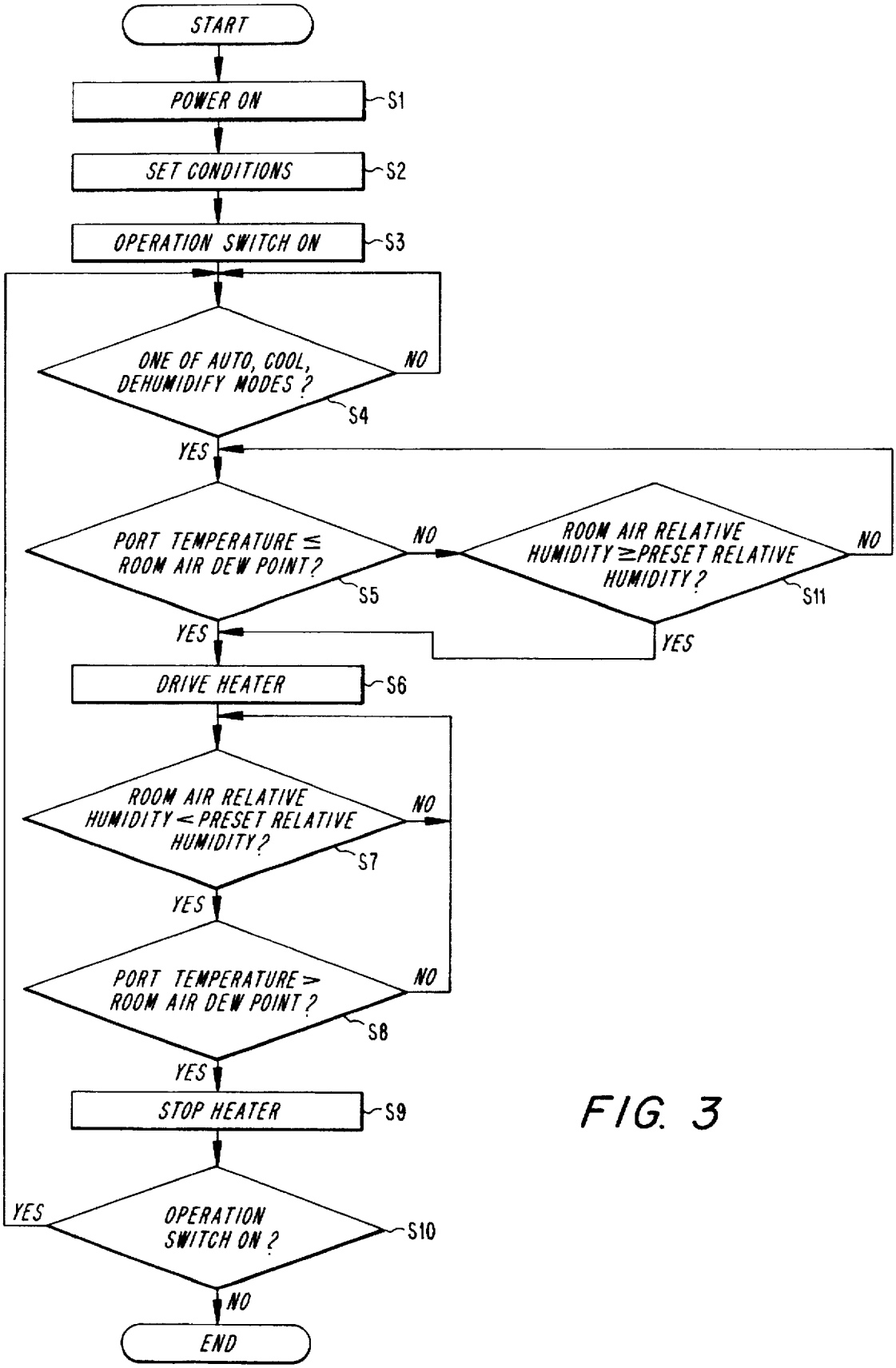
FIG. 3 is a flowchart showing the process for controlling the dew preventing device of the invention.
Figure 4:
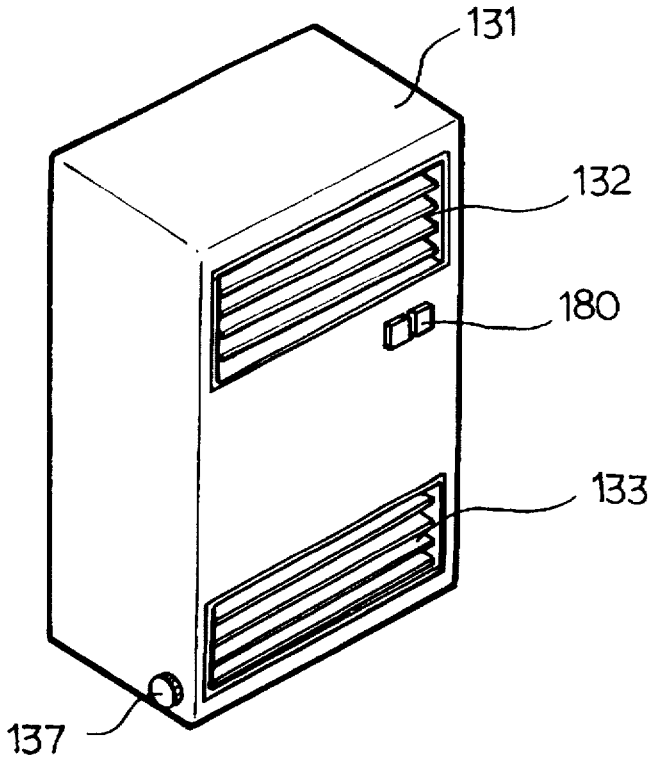
FIG. 4 (PRIOR ART)
FIG. 4 is a perspective view of a prior art air conditioner.

Referring next to FIG. 3, there is shown a flowchart showing the process for controlling the above dew preventing device.

As shown in the drawing, a power switch (not shown) included in the control panel 28 is turned on at step S1. Therefore, a DC voltage of 5V is applied to the control means 40.

At the next step S2, desired conditions are set using a remote controller 47.

For example, when a user selects "cooling mode" of the operating modes, which operating modes include an automatic mode, a cooling mode, a dehumidifying mode and a blowing mode, and sets the desired room temperature at "23° C.", the object wind velocity at "medium" and the object blowing direction at "downward", infrared signals representing the above set conditions are applied from the remote controller 47 to an infrared signal receiver 48 of the housing 2. Therefore, set signals are outputted from the infrared signal receiver 48 to a fifth input terminal 15 of the control means 40.

Thereafter, the user turns on an operating switch of the remote controller 47 at the next step S3. An infrared signal representing the operational start of the air conditioner is transmitted to the infrared signal receiver 48 from the remote controller 47. Therefore, a start signal is outputted from the infrared signal receiver 48 to the fifth input terminal I5 of the control means 40.

At the next step S4, a compressor drive signal is outputted from a second output terminal O2 of the control means 40 to the compressor drive circuit 46. At the same time, a fan motor drive signal is outputted from a third output terminal O3 of the control means 40 to a fan motor drive circuit 50. Upon receiving the compressor drive signal, the compressor drive circuit 46 applies an AC voltage of 220V to the compressor 44 and operates the compressor 44. Upon receiving the fan motor drive signal, the fan motor drive circuit 50 applies an AC voltage of 220V to a fan motor 52 and operates the fan motor 52, thereby starting a blower fan 54. As the blower fan 54 is started, the room air is sucked into the housing 2 through the air suction port 6. In the housing 2, the room air circulates about the heat exchanger while being cooled. The cooled air in turn is discharged from the housing 2 to the room through the grilled air discharge port 8, thus cooling the room.

At step S4, the control means 40 determines whether the present operation mode of the air conditioner is in the automatic mode, the cooling mode or the dehumidifying mode. When the answer is yes or when it is determined that the present operation mode of the air conditioner is in one of the above modes, the control means 40 performs the next step S5 for preventing dew-forming at the air discharge port 8.

At step S5, a temperature signal representing the room air temperature is outputted from the first temperature sensor 20 to a first input terminal I1 of the control means 40. In addition, a humidity signal representing the room air humidity is outputted from the humidity sensor 22 to a second input terminal I2 of the control means 40. At the same time, the temperature signal representing the temperature of the air discharge port 8 is outputted from the second temperature sensor 24 to a third input terminal I3 of the control means 40.

Upon receiving the above signals, the control means 40 calculates the dew point of the room temperature on the basis of both the room air temperature and the room air humidity. Thereafter, the control means 40 determines whether the temperature of the grilled air discharge port 8 is equal to or lower than the calculated dew point of the room air. When the answer is yes, that is, when it is determined that the temperature of the air discharge port 8 is equal to or lower than the dew point of the room air, the grille 56 of the air discharge port 8 will tend to be laden with dew when the cooled air discharged from the housing 2 to the room through the port 8 meets with the room air at that port 8. The control means 40 performs a next step S6 to raise the temperature of the grilled air discharge port 8.

At step S6, a heater drive signal is outputted from a first output terminal O1 of the control means 40 to the heater drive circuit 42. Upon receiving the heater drive signal, the heater drive circuit applies an AC voltage of 220V to the heaters 34 and 36. The heaters 34 and 36 thus start to heat their associated holders 30 and 32, thereby raising the temperatures of the top and bottom portions of the grilled air discharge port 8 until the temperature of the port 8 becomes higher than the dew point of the room air. Therefore, there is no dew formed at the grille 56 of the air discharge port 8 even when the room air meets with the cooled air at that grilled port 8.

At the next step S7, the control means 40 calculates a relative humidity of the room air on the basis of both the temperature and the absolute humidity of the room air. The control means 40 also determines whether the calculated relative humidity of the room air is lower than a preset relative humidity stored in the control means 40. In this case, the preset relative humidity was preset in accordance with a wind velocity or a rotating velocity of the blower fan 54 as represented in Table 1. When the calculated relative humidity of the room air is lower than the preset relative humidity, the room air is in dry state in comparison with the wind velocity. In this case, there is no possibility of dew-forming at the grille 56 of the air discharge port 8 so that the control means 40 performs the next step S8.

TABLE 1

| wind velocity | preset relative humidity |
|---|---|
| strong | 90% |
| medium | 85% |
| weak | 80% |

At step S8, the control means 40 determines whether the temperature of the grilled air discharge port 8 is higher than the dew point of the room air. When the temperature of the air discharge port 8 is higher than the dew point of the room air, dew will not form at the grille 56 of the air discharge port 8 so that the control means 40 performs the next step S9 to stop the heaters 34 and 36.

At step S9, a stop signal is outputted from the first output terminal O1 of the control means 40 to the heater drive circuit 42. Therefore, the heater drive circuit 42 does not apply the voltage to the heaters 34 and 36, thus stopping the heaters 34 and 36.

At the next step S10, the control means 40 determines whether the operating switch of the remote controller 47 has been turned on. When the operating switch is not turned on, the air conditioner is not operated so that the control means 40 continuously stops the heaters 34 and 36.

At step S4, when it is determined that the operating mode is neither the automatic mode, the cooling mode nor the dehumidifying mode, the present operating mode is a blowing mode wherein dew will not form at the air discharge port 8. In this case, the control means 40 continuously stops the heaters 34 and 36.

At step S5, when it is determined that the dew point of the room air is lower than the temperature of the air discharge port 8, the control means 40 performs step S11 for determining the relative humidity of the room air.

At step 11, the control means 40 calculates a relative humidity of the room air on the basis of both the temperature and the absolute humidity of the room air. The control means 40 also determines whether the calculated relative humidity of the room air is equal to or higher than the preset relative humidity stored in the control means 40. The preset relative humidity was preset in accordance with the wind velocity or the rotating velocity of the blower fan 54 as represented in Table 1. When the calculated relative humidity of the room air is equal to or higher than the preset relative humidity, the room air has a relatively higher humidity so that the room air may form dew at the grille 56 of the air discharge port 8 even when the temperature of the port 8 is not lower than the dew point of the room air. Therefore, the control means 40 in this case performs step S6 for driving the heaters 34 and 36 and preventing dew from forming at the grilled port 8.

At step S11, when the calculated relative humidity of the room air is lower than the preset relative humidity, the room air has a relatively lower humidity so that dew will not form at the grille 56 of the air discharge port 8. Therefore, the control means 40 continues the normal cooling operation and performs step S5 for determining whether the temperature of the grilled air discharge port 8 is equal to or lower than the dew point of the room air.

At step S7, when the calculated relative humidity of the room air is not lower than the preset relative humidity of the control means 40, the relative humidity of the room air is relatively higher so that dew may form at the grille 56 of the air discharge port 8. The control means 40 in this case continuously operates the heaters 34 and 36.

At step S8, when the temperature of the air discharge port 8 is not higher than the dew point of the room air, the control means 40 performs step S7 for continuously operating the heaters 34 and 36, thereby raising the temperature of the port 8.

At step S10, when the operating switch of the remote controller 47 has been turned on, the control means 40 performs step S4 for repeatedly controlling the heaters 34 and 36 in the same manner as described above.

When the user turns on a forcible drive switch for heaters of the remote controller 47 while controlling the heaters 34 and 36 as described above, an infrared signal representing the forcible drive for the heaters is outputted from the remote controller 47 to the infrared signal receiver 48. Therefore, the infrared signal receiver 48 outputs a forcible drive signal for heaters to the fifth input terminal I5 of the control means 40. The heaters 34 and 36 thus generate heat under the control of the control means 40 regardless of the conditions of the room air.

On the other hand, when the user turns on a forcible stop switch for heaters of the remote controller 47, an infrared signal representing the forcible stop for the heaters is outputted from the remote controller 47 to the infrared signal receiver 48. Therefore, the infrared signal receiver 48 outputs a forcible stop signal for heaters to the fifth input terminal I5 of the control means 40. The heaters 34 and 36 are thus stopped under the control of the control means 40 regardless of the conditions of the room air.

In the above preferred embodiment of the invention, the heaters 34 and 36 and their associated holders 30 and 32 are provided at the top and bottom portions of the air discharge port 8. However, it should be understood that the dew preventing device of this invention may be provided with one heater and an associated holder which are provided at either the top portion or the bottom portion of the air discharge port 8.

Additionally, it should be understood that the preset relative humidities represented in Table 1 may be changed in accordance with environmental conditions of the air conditioner.

As described above, the dew preventing device for air conditioners of the present invention includes holders provided at the top and bottom portions of the grilled air discharge port and a pair of heaters held by the holders respectively. The dew preventing device operates the heaters when the temperature of the grilled air discharge port is lower than the dew point of the room air, thereby raising the temperature of that grilled port and preventing dew-forming at that grilled port. The dew preventing device of this invention thus keeps the air conditioner clean and is convenient to the users.

Furthermore, the dew preventing device of this invention prevents the control panel from being moisturized by the dew formed at the grilled port so that the air conditioner with the above device can be used safely. Therefore, the above device prevents short circuits as well as fire from happening in the air conditioner thereby preventing financial loss to the owner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. In an air conditioner including a body for receiving incoming air from a room, a cooling mechanism for cooling the incoming air, and a discharge port for discharging the cooled air back into the room, the discharge port including grilles, the improvement wherein the air conditioner comprises:

a heating means for heating the grilles of the discharge port;

a first temperature sensing means for detecting the temperature of incoming air and providing a first temperature signal in accordance therewith;

a humidity sensing means for sensing the humidity of the incoming air and providing a humidity signal in accordance therewith;

a second temperature sensing means for detecting the temperature of cooled air cooled by the cooling mechanism and providing a second temperature signal in accordance therewith; and a control means connected to the heating means, the first and second temperature sensing means, and the humidity sensing means for activating the heating means when said first and second temperature signals and said humidity signal indicate the presence of dew-forming conditions at said discharge port, wherein the control means is operable to calculate a dew point of the room temperature on the basis of the first temperature signal and the humidity signal, and activate said heating means when the second temperature is less than the room air dew point.

2. The air conditioner according to claim 1 wherein the control means is operable to compare the humidity signal with a reference humidity signal and activate the heating means when the room humidity exceeds the reference humidity.

3. The air conditioner according to claim 1 wherein the air conditioner includes a holder disposed adjacent the air discharge port, the holder formed of a thermal conducting material, the heating means arranged to heat the holder.

4. The air conditioner according to claim 1 wherein said air conditioner includes a housing, the heating means comprising heating wires disposed in the holder, the holder comprising projections for mounting the holder to the housing and spacing the heating wires from one another.

5. The air conditioner according to claim 1 wherein the humidity sensing means is an electric resistance hygrometer.

6. The air conditioner according to claim 1 wherein each of the first and second temperature sensing means is a thermistor.

7. A method of preventing the formation of dew on the grilles of a cool air discharge port of a room air conditioner, comprising the steps of:

sensing a temperature of room air entering the air conditioner and providing a first temperature signal in accordance therewith;

sensing a humidity of the room air and providing a humidity signal in accordance therewith;

sensing a temperature of cooled air being discharged through the discharge port and providing a second temperature signal in accordance therewith; and supplying the first and second temperature signals and the humidity signal to a control device which calculates a dew point for the room temperature on the basis of the first temperature signal and the humidity signal and activates a heater for heating the grilles of the discharge port in response to the cooled air temperature being less than the room dew point, and in response to the humidity signal exceeding a reference humidity signal.

8. In an air conditioner including a body for receiving incoming air from a room, a cooling mechanism for cooling the incoming air, and a discharge port for discharging the cooled air back into the room, the discharge port including grilles, the improvement wherein the air conditioner comprises:

a heating means for heating the grilles of the discharge port;

a first temperature sensing means for detecting the temperature of incoming air and providing a first temperature signal in accordance therewith;

a humidity sensing means for sensing the humidity of the incoming air and providing a humidity signal in accordance therewith;

a second temperature sensing means for detecting the temperature of cooled air cooled by the cooling mechanism and providing a second temperature signal in accordance therewith; and a control means connected to the heating means, the first and second temperature sensing means, and the humidity sensing means for activating the heating means when said first and second temperature signals and said humidity signal indicate the presence of dew-forming conditions at said discharge port, wherein the control means is operable to compare the humidity signal with a reference humidity signal and activate the heating means when the room humidity exceeds the reference humidity.

9. In an air conditioner including a body for receiving incoming air from a room, a cooling mechanism for cooling the incoming air, and a discharge port for discharging the cooled air back into the room, the discharge port including grilles, the improvement wherein the air conditioner comprises:

a heating means for heating the grilles of the discharge port;

a first temperature sensing means for detecting the temperature of incoming air and providing a first temperature signal in accordance therewith;

a humidity sensing means for sensing the humidity of the incoming air and providing a humidity signal in accordance therewith;

a second temperature sensing means for detecting the temperature of cooled air cooled by the cooling mechanism and providing a second temperature signal in accordance therewith;

a control means connected to the heating means, the first and second temperature sensing means, and the humidity sensing means for activating the heating means when said first and second temperature signals and said humidity signal indicate the presence of dew-forming conditions at said discharge port; and a holder disposed adjacent the air discharge port, the holder formed of a thermal conducting material, the heating means arranged to heat the holder.

10. In an air conditioner including a body for receiving incoming air from a room, a cooling mechanism for cooling the incoming air, and a discharge port for discharging the cooled air back into the room, the discharge port including grilles, the improvement wherein the air conditioner comprises:

a heating means for heating the grilles of the discharge port;

a first temperature sensing means for detecting the temperature of incoming air and providing a first temperature signal in accordance therewith;

an electric resistance hygrometer for sensing the humidity of the incoming air and providing a humidity signal in accordance therewith;

a second temperature sensing means for detecting the temperature of cooled air cooled by the cooling mechanism and providing a second temperature signal in accordance therewith; and a control means connected to the heating means, the first and second temperature sensing means, and the hygrometer for activating the heating means when said first and second temperature signals and said humidity signal indicate the presence of dew-forming conditions at said discharge port.

11. In an air conditioner including a body for receiving incoming air from a room, a cooling mechanism for cooling the incoming air, and a discharge port for discharging the cooled air back into the room, the discharge port including grilles, the improvement wherein the air conditioner comprises:

a heating means for heating the grilles of the discharge port;

a first thermistor for detecting the temperature of incoming air and providing a first temperature signal in accordance therewith;

a humidity sensing means for sensing the humidity of the incoming air and providing a humidity signal in accordance therewith;

a second thermistor for detecting the temperature of cooled air cooled by the cooling mechanism and providing a second temperature signal in accordance therewith; and a control means connected to the heating means, the first and second temperature thermistors, and the humidity sensing means for activating the heating means when said first and second temperature signals and said humidity signal indicate the presence of dew-forming conditions at said discharge port.

* * * * *